United States Patent [19]

Brangle, Jr.

[11] Patent Number: 5,009,362

[45] Date of Patent: Apr. 23, 1991

[54] QUICK-ASSEMBLED FOLDING CARTON WITH REINFORCED BOTTOM THAT LOCKS IN POSITION

[76] Inventor: Edward J. Brangle, Jr., 11885 Lackland Rd., Ste. 26, St. Louis, Mo. 63146

[21] Appl. No.: 583,577

[22] Filed: Sep. 17, 1990

Related U.S. Application Data

[63] Continuation-in-part of Ser. No. 328,066, Mar. 23, 1989, abandoned.

[51] Int. Cl.[5] ..... B65D 5/36

[52] U.S. Cl. ..... 229/117; 229/117.01; 229/117.03

[58] Field of Search ..... 229/117, 183, 120, 117.01, 229/117.03, 117.04, DIG. 9

[56] References Cited

U.S. PATENT DOCUMENTS

| | | | |
|---|---|---|---|
| 2,942,767 | 6/1960 | Weiss | 229/16 |
| 3,032,252 | 5/1962 | Hill | 229/37 |
| 3,289,914 | 12/1966 | Lange-Wiehe | 229/31 |
| 3,731,873 | 5/1973 | Brangle, Jr. | 229/41 |
| 4,146,149 | 3/1979 | Meyers et al. | 229/41 |
| 4,337,887 | 7/1982 | Gerard et al. | 229/16 |
| 4,491,267 | 1/1985 | Tisma | 229/37 |

*Primary Examiner*—Gary E. Elkins

*Attorney, Agent, or Firm*—Rogers, Howell & Haferkamp

[57] ABSTRACT

A folding carton formed from a blank sheet of carton material comprises an improved carton bottom section having three flanges that are connected to three sides of the carton bottom section and are arranged to extend at a right angle to the carton bottom section when the carton is folded into a rectangular configuration to provide additional support against bending of the carton bottom section. The carton bottom section is arranged to be locked in position at the bottom of a rectangular configuration formed by the four side walls of the folding carton. The carton bottom section is locked in position by the three flanges engaging overhanging ledges formed by three reinforcement flaps adhered to the interiors of three of the four carton side walls, or by a pair of tabs extending from opposite sides of the carton bottom section and a flange engaging in three slots formed in three of the side walls of the folding carton. A diagonal line is scored across the carton bottom section to permit bending of the bottom section across the diagonal line to facilitate the insertion of the bottom section into the rectangular configuration formed by the four carton wall sections.

27 Claims, 4 Drawing Sheets

QUICK-ASSEMBLED FOLDING CARTON WITH REINFORCED BOTTOM THAT LOCKS IN POSITION

This is a continuation in part of application Ser. No. 07/328,066, filed Mar. 23, 1989, now abandoned.

BACKGROUND OF THE INVENTION (1) Field of the Invention

The present invention relates to folding cartons and in particular folding cartons that are cut from a sheet of carton material in mutually confronting arrangement that conserves material, and that are quickly folded from a flat configuration to a rectangular box configuration with a reinforced bottom wall that is pressed into the rectangular box configuration and locked in position at the bottom of the box without gluing.

The invention pertains to and is an improvement over cartons of the type disclosed in U.S. Pat. No. 3,731,873.

(2) Description of the Related Art

The U.S. Pat. No. 3,731,873 discloses the type of folding carton to which the present invention pertains. This prior art carton comprises four rectangular wall sections connected end-to-end with fold lines scored between adjacent wall sections. A tab is provided at one end of the wall sections and is arranged to be glued to the wall section at the opposite end of the connected wall sections to enable the walls to be formed into the rectangular box configuration.

Each wall section has a wall reinforcement flap connected along its top edge. The reinforcement flap is arranged to be folded over a fold line between the top edge of the wall section and the reinforcement flap, and to be glued to the inside surface of the wall section. When the four wall sections are folded into their rectangular box configuration, three of the wall reinforcement flaps glued to the inside surface of the wall sections form two locking ledges overhanging the interior surfaces of two of the wall sections, and a cutout ledge overhanging a fraction of the interior surface of a third wall section.

One of the four carton wall sections is connected to a carton bottom along a fold line at the bottom of the wall section, and the remaining wall sections are connected to bottom supports along fold lines at the bottom of the wall sections. The carton bottom is adapted to be folded into the rectangular box configuration formed by the folded wall sections and supported by the three bottom supports at the bottom of the box. The carton bottom is locked in place by first and second side flanges extending along first and second edges of the carton bottom, and a tab that extends along a portion of a third edge of the carton bottom. With the carton bottom positioned at the bottom of the box, the first and second side flanges extend along and engage with the two overhanging locking ledges formed by the reinforcement flaps glued to the interior surfaces of the wall sections, and the tab engages with the cutout ledge formed by the reinforcement flap glued to the third wall section. The engagement of the side flanges and the tab with the reinforcement flaps locks the carton bottom in position and prevents it from being pushed up into the rectangular box configuration formed by the wall sections of the folded carton. The bottom supports prevent the carton bottom from being pushed down, out of the rectangular box configuration formed by the wall sections of the folded carton.

This prior art folding carton has disadvantages that are due to the manner in which the folding carton is cut from the blank sheet of carton material. The wall reinforcement flaps of the carton provide an overhanging locking ledge across only two of the side walls and only a small, cutout overhanging ledge across a portion of the third side wall. The bottom side flanges extend completely across only two sides of the carton bottom. These side flanges engage with the two locking ledges of the wall reinforcement flaps and also provide reinforcement against bending to two sides of the carton bottom. The tab on the third side of the carton bottom only locks that side in place and does not provide reinforcement to the bottom section to prevent bending as do the two side flanges.

Also, the production of the prior art container wastes a substantial amount of carton material. The outline of the prior art container permits only a partial nesting of the two carton outlines. The two cartons confront each other along only a limited portion of their outlines, leaving a substantial amount of the carton material remaining between the two carton outlines that is discarded as waste after the carton has been cut.

The present invention overcomes the above-cited shortcomings of the prior art folding carton by providing a carton that comprises reinforcing flaps adhered to the interior surfaces of the four carton wall sections and presenting three overhanging locking ledges across the entire surfaces of three of the wall sections. The bottom of the carton of the present invention comprises three strengthening flanges that extend along the entire lengths of three sides of the carton bottom and prevent bending of the carton bottom. The three strengthening flanges also engage with the three overhanging locking ledges to hold the bottom of the carton in place at the bottom of the rectangular box configuration formed from the carton wall sections.

A second embodiment of the invention also comprises three strengthening flanges that extend along the entire lengths of three sides of the carton bottom and prevent bending of the carton bottom. Portions of the three strengthening flanges of the second embodiment engage in slots in three of the cartons wall sections to hold the bottom of the carton in place at the bottom of the rectangular box configuration formed from the carton wall sections.

The outline of the folding carton of the present invention enables two cartons to mutually confront each other and be cut from the same rectangular area of carton material, resulting in a more efficient use of the carton material than in the prior art folding cartons.

It is therefore an object of the present invention to provide a folding carton with an improved strengthening flange arrangement that provides additional support against bending to the carton bottom while locking the bottom in place when the carton is folded into a rectangular box configuration, and also provides a carton outline dimensioned to mutually confront a second carton and enable the two folding cartons to be cut from the same rectangular area of carton material.

SUMMARY OF THE INVENTION

The folding carton of the present invention comprises four wall sections. Each wall section has a rectangular configuration with top and bottom edges and two side edges. The four wall sections are arranged side-by-side in a straight line with adjacent side edges of the wall sections being connected together along fold lines scored between the adjacent wall sections. A flap is provided at one end of the line of wall sections and is arranged to be glued to the opposite end of the wall sections to enable the wall sections to be formed into a rectangular configuration.

Each of the wall sections is connected to a reinforcement flap along its top edge. A fold line is provided between each of the wall sections and its connected reinforcement flap. The reinforcement flaps are arranged to be folded over at the fold line and adhered to the interior surface of the carton wall sections. Each of the reinforcement flaps has a rectangular configuration except for one which has a portion of the flap removed in order to expose a portion of the interior surface of the wall section to which the connecting flap is glued to form the wall sections into a rectangular configuration. The reinforcement flaps have a lesser height than the wall sections of the carton and the folded over reinforcement flaps do not cover the entire interior surface of the wall sections so that the edges of the flaps opposite the fold lines present an overhanging ledge above the bottom edge of each of the wall sections.

One of the wall sections of the carton is connected to a carton bottom. The carton bottom has a rectangular configuration substantially the same as the rectangular configuration formed by the four carton wall sections. An edge of the carton bottom is connected to a bottom edge of the wall section along a fold line. The remaining three edges of the carton bottom are connected to strengthening flanges along their entire lengths. Fold lines are provided between the strengthening flanges and the bottom section, and the flanges are adapted to fold over at the fold lines to positions that are at right angles to the carton bottom when the carton is formed into the rectangular box configuration. The folded flanges provide additional strength to resist bending of the carton bottom and the edges of the flanges opposite the fold line connections to the carton bottom are arranged to engage the overhanging ledges formed by the reinforcement flaps to prevent the carton bottom from being pushed up through the rectangular box configuration formed by the carton wall sections.

Three carton bottom supports are connected to the bottom edges of the three remaining carton wall sections. Fold lines are provided between each carton bottom support and the associated carton wall section. The three carton bottom supports are arranged to support the carton bottom in position at the bottom of the rectangular box configuration formed from the carton wall sections, and to prevent the carton bottom from being pushed out of the rectangular configuration.

The outline of the folding carton of the present invention, and in particular the outline of the three bottom support sections, is determined to enable the cutting of two folding cartons from the same rectangular section of carton material. The two cartons are arranged so that free edges of the carton bottom supports opposite their connections to the wall sections of the two cartons confront each other, and a single line cut in the rectangular section of carton material defines the free edges of the three carton bottom supports of each carton.

A second embodiment of the present invention is substantially identical to the folding carton described above except that it does not employ reinforcement flanges. This embodiment therefore does not have the overhanging ledges on the inside of the carton walls that engage the free edges of the strengthening flanges connected to the carton bottom and maintain the bottom section in its position at the bottom of the rectangular box configuration formed from the four wall sections.

The second embodiment of the present invention comprises a pair of slots provided adjacent the bottom edges of two of the wall sections of the folding carton. The two wall sections make up the confronting side walls of the carton when it is folded into its rectangular box configuration. Like the first embodiment, the two confronting side walls are connected along fold lines to a second pair of mutually confronting wall sections that make up the front and back walls of the carton when the walls are folded into the rectangular box configuration.

A third slot is provided in the front wall section of the carton. The carton bottom is connected along a fold line to a bottom edge of the back wall section of the carton. The bottom of the carton includes a pair of tabs extending from opposite side edges of the bottom in addition to the strengthening flanges connected along three of the carton edges as in the first embodiment.

The carton bottom of the second embodiment is arranged to be folded into the rectangular box configuration formed by the four wall sections of the folding carton and have the two tabs protruding from the opposite sides of the carton bottom engage in the two slots provided in the two carton wall sections that make up the opposed side walls of the carton in its rectangular box configuration. The strengthening flange extending across the front of the carton bottom engages in the third slot formed in the front wall section of the folding carton when the carton is folded into its rectangular configuration. The two tabs engage in the side wall slots and the front strengthening flange engages in the front wall slot to maintain the carton bottom in its position at the bottom of the rectangular box configuration of the folded carton.

A diagonal line is scored across the carton bottom of both embodiments to permit folding of the carton bottom along the line and facilitate the insertion of the bottom into the rectangular configuration formed by the folded carton walls.

BRIEF DESCRIPTION OF THE DRAWINGS

Further objects and features of the present invention are revealed in the following detailed description of the preferred embodiments of the invention and in the drawing figures wherein.

DETAILED DESCRIPTION OF THE PREFERRED EMBODIMENT

Figure 1:
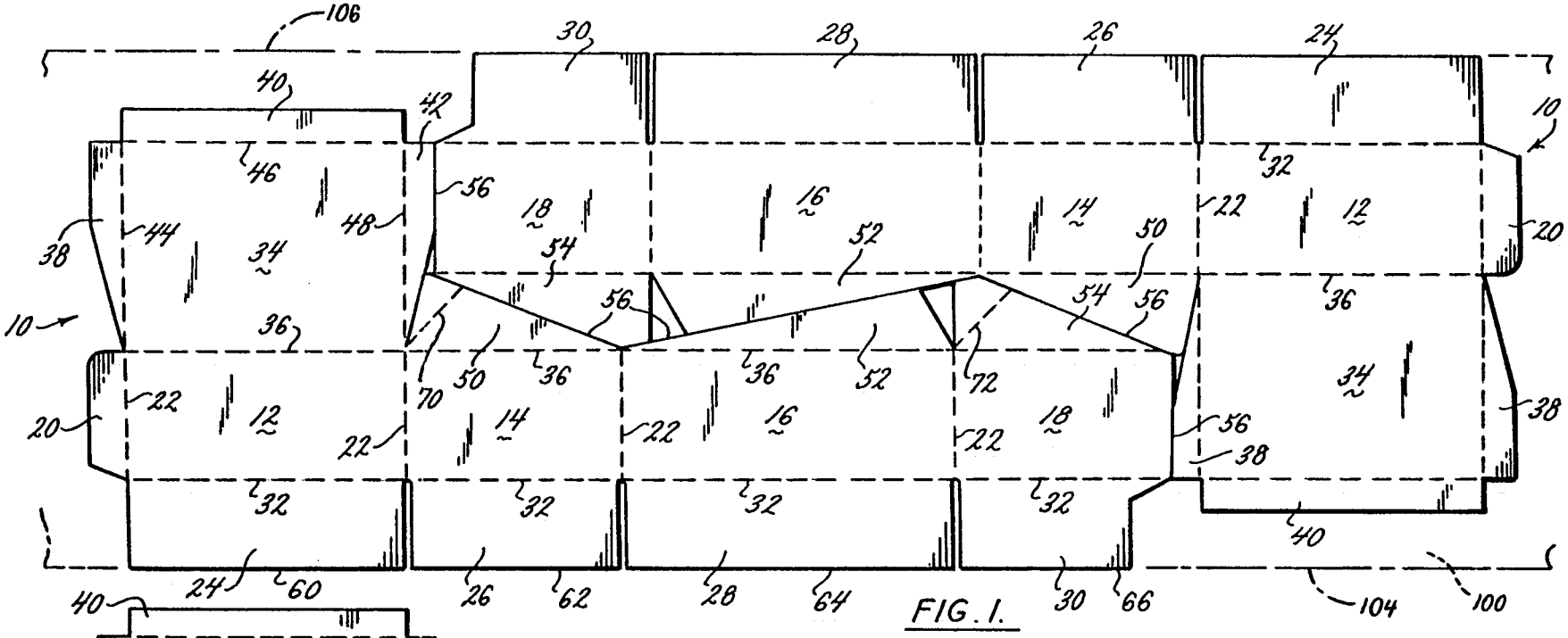
FIG. 1 is a view showing the arrangement of two confronting cartons of the present invention on a single rectangular sheet of carton material.

FIG. 1 shows the arrangement of two cartons 10 of the first embodiment of the invention cut into a single rectangular sheet of blank carton material. The carton comprises a first back wall section 12, a second side wall section 14, a third front wall section 16, and a fourth side wall section 18 connected together in end-to-end fashion. A closure flap 20 is connected to an end of the first wall section 12. Four fold lines 22 are scored on the folding carton separating the adjacent wall sections from each other and separating the closure flap 20 from the first wall section 12.

The folding carton also comprises a first reinforcement flap 24 connected to the back wall section 12, a second reinforcement flap 26 connected to the side wall section 14, a third reinforcement flap 28 connected to the front wall section 16, and a fourth reinforcement flap 30 connected to the side wall section 18. Each of the reinforcement flaps is connected to its respective wall section along a fold line 32 extending along the top edge of the four wall sections.

The folding carton comprises a carton bottom 34 that is connected to the back wall section 12 along a fold line 36 between a first side of the carton bottom 34 and the bottom edge of the back wall section 12. The carton bottom 34 has a rectangular configuration and is connected to first, second and third strengthening flanges 38, 40, 42 along the three remaining sides of the bottom 34. First, second and third fold lines 44, 46, 48 are provided between the respective first, second and third strengthening flanges 38, 40, 42 and the carton bottom 34.

A first bottom support 50 is connected to the side wall section 14 along the fold line 36. A second bottom support 52 is connected to the front wall section 16 along the fold line 36, and a third bottom support 53 is connected to the side wall section 18 along the fold line 36.

As can be seen in FIG. 1, the folding cartons of the present invention are configured so that two folding cartons can overlap and substantially occupy the same area of a rectangular portion of blank carton sheet material. A common dividing line 56 is cut between the mutually confronting folding cartons, resulting in less wasted carton material between the two folding cartons cut from the same sheet of carton material and a more efficient use of the carton material in the production of each folding carton.

Figure 2:
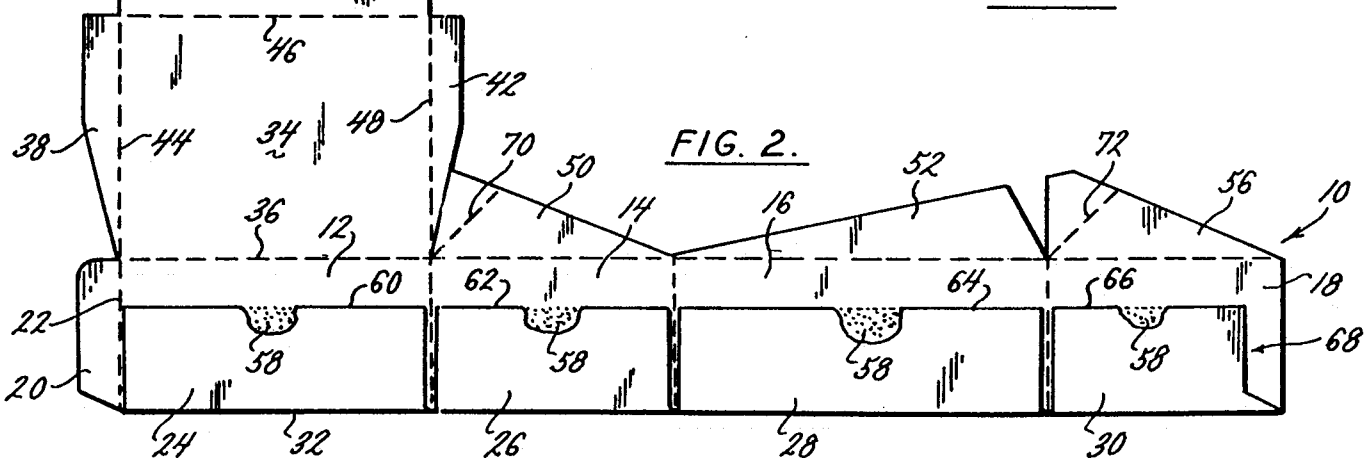
FIG. 2 shows the first step involved in producing the folding carton of the present invention from a carton outline shown in FIG. 1.

FIG. 2 shows the first step involved in the manufacture of the folding carton of the present invention after it has been cut from a blank sheet of carton material. In the first step, the first, second, third and fourth reinforcement flaps 24, 26, 28, 30, are folded across the fold line 32 and adhered to the interior surface of the respective first, second, third and fourth wall sections 12, 14, 16, 18 by applying glue 58 between each of the flaps and its connected wall section. With each of the four reinforcement flaps folded over at the fold line 32 and glued to the interior surfaces of the four carton wall sections, the four edges 60, 62, 64, 66, of the four respective reinforcement flaps 24, 26, 28, 30, form four separate colinear overhanging ledges above the fold line 36 that extends across the bottom edge of the four wall sections. The purpose for these four overhanging ledges formed by the reinforcement flaps will be fully explained later. It should be noted that the first three reinforcement flaps 24, 26, 28 have a rectangular configuration while the fourth reinforcement flap 30 has the configuration of a rectangle with an end portion 68 of the rectangle removed. This is done to expose an area of the fourth wall section 18 to be adhered to the closure flap 20 in a manner to be described later.

Figures 3, 4, 5, 6, 7, 8:
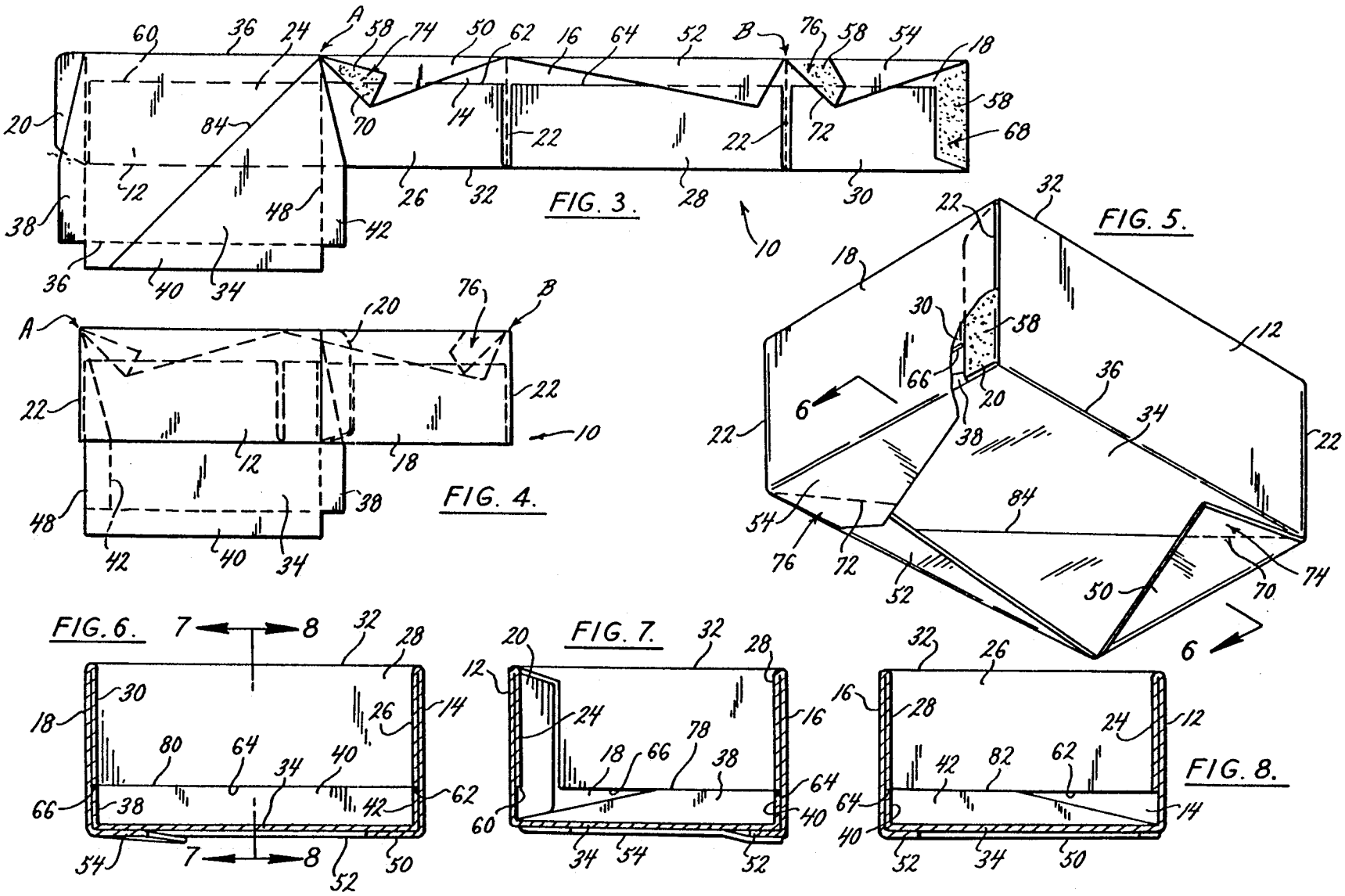
FIG. 3 shows a second step involved in the production of the folding carton of the present invention.
FIG. 4 shows a fourth step involved in the production of the folding carton of the present invention.
FIG. 5 is a partially cut away perspective view of the bottom of the folding carton of the present invention folded into its rectangular box configuration.
FIG. 6 is a cut away view of the folding carton of the present invention taken along line 6—6 of FIG. 5.
FIG. 7 is a cut away view of the folding carton of the present invention taken along line 7—7 of FIG. 6.
FIG. 8 is a cut away view of the folding carton of the present invention taken along line 8—8 of FIG. 6.

FIG. 3 shows the second step involved in the manufacture of the folding carton. In the second step, the carton bottom 34 and the first, second and third carton bottom supports 50, 52, 54, are folded over at the fold line 36 onto the first, second, third and fourth reinforcement flaps 24, 26, 28, 30, that have been previously adhered to the interior surface of the first, second, third and fourth carton wall sections 12, 14, 16, 18 respectively. The first and third bottom supports 50, 54 have respective fold lines 70, 72 extending diagonally across the bottom supports. In the second step of manufacturing the folding carton, the first and third bottom supports 50, 54, are folded over at the respective fold lines, 70, 72, to expose areas 74, 76 of the respective bottom supports 50, 54 for receiving glue. Glue 58 is applied to the two exposed surfaces 74, 76, of the respective bottom supports 50, 54, and to the area 68 of the fourth wall section 18 exposed by the removed end portion of the reinforcement flap 30 to complete the second step of the manufacture of the folding carton.

In the third step of the manufacture of the folding carton, the first wall section 12 and the carton bottom section 34 are together folded over both the fold line 22 between the first and second carton wall sections 12, 14, and the fold line 48 between the carton bottom 34 and the third strengthening flange 42. The first wall section 12 and the carton bottom 34 are folded to the right as seen in FIG. 3 across the fold lines 22 and 48 indicated at point A in FIG. 3. By folding over the first wall section 12 and the carton bottom section 34 in this manner, the exposed area 74 of the first bottom support 50 is pressed against the carton bottom section 34 and adhered to the carton bottom section 34 by the glue 58 that has been applied to the area 74 of the first bottom support 50. It is pointed out that the strengthening flange 42 is now folded back against a surface of the carton bottom 34 that will be the bottom surface of the carton when it is folded into its rectangular box configuration. When folding the carton into the rectangular box configuration, the flange 42 must be folded around the fold line 48 to a position extending at a right angle to the carton bottom 34 and into the rectangular box configuration formed by the four carton wall sections 12, 14, 16, 18.

The fourth carton wall section 18 is now folded over to the left as seen in FIG. 3 across the fold line 22 between the third and fourth carton wall sections 16, 18, indicated at the point B. This causes the exposed area 76 of the third bottom support 54 to press against the second bottom support 52. The glue 58 applied to the exposed area 76 of the third bottom support 54 causes the third bottom support to be adhered to the second bottom support 52.

As the fourth carton wall section is folded over, the glue 58 applied to the exposed area 68 of the fourth carton wall section 18 is pressed against the closure flap 20 attached to the first carton wall section 12, thereby securing the fourth carton wall section 18 to the first carton wall section 12. This completes the manufacture of the folding carton. The folding carton is now in its flat-folded, three-layer configuration with the first and fourth wall sections 12, 18 making up the top layer, the carton bottom 34 making up the middle layer, and the second and third carton wall sections 14, 16 making up the bottom layer of the flat-folded configuration.

To assemble the folding carton into its rectangular box configuration, the flat-folded configuration of the carton is unfolded so that the first and third carton wall sections 12, 16, confront each other and the second and fourth carton wall sections 14, 18 confront each other. As the carton is folded into its rectangular box configuration, the glued connection between the second bottom support 52 and the third bottom support 54 causes both bottom supports to fold out from the third and fourth carton wall sections 16, 18 respectively and to extend at a right angle to the third and fourth carton wall sections. The glue connecting the first bottom support 50 to the carton bottom 34 causes the first bottom support 50 to fold out and extend at a right angle to the second carton wall section 14 and to pull the carton bottom 34 down into the rectangular box configuration formed by the four carton wall sections. To complete the unfolding of the carton into its rectangular box configuration, the bottom section 34 is pushed downward into the rectangular box configuration formed by the four carton wall sections until it rests on the three bottom supports 50, 52, 54 as seen in FIG. 5. As the carton bottom 34 is pushed into the rectangular box configuration, the strengthening flange 42 is folded around the fold line 48 to a position where it extends at a right angle to the inside surface of the carton bottom 34 and into the rectangular box configuration formed by the four carton wall sections 12, 14, 16, 18. As the bottom 34 is pressed into the box, the other two strengthening flanges 38, 40 contact the wall sections 18 and 16 respectively, and are also folded at right angles to the bottom 34. A diagonal score line 84 is provided across the bottom of the carton bottom section to enable the bottom section to bend at the score line 84 and to facilitate the insertion of the carton bottom section 34 into the rectangular configuration formed by the four carton wall sections. In this position of the carton bottom section 34, the strengthening flanges 38, 40, 42 engage beneath the overhanging ledges formed by the free flap edges 66, 64, 62, respectively. Top edges 74, 76, 78 of the respective three strengthening flanges 38, 40, 42 engage beneath the overhanging ledges 66, 64, 62 of the respective reinforcement flaps 30, 28, 26 and maintain the carton bottom 34 in its position at the bottom of the rectangular box configuration formed by the four wall sections of the folding carton.

Figure 9:
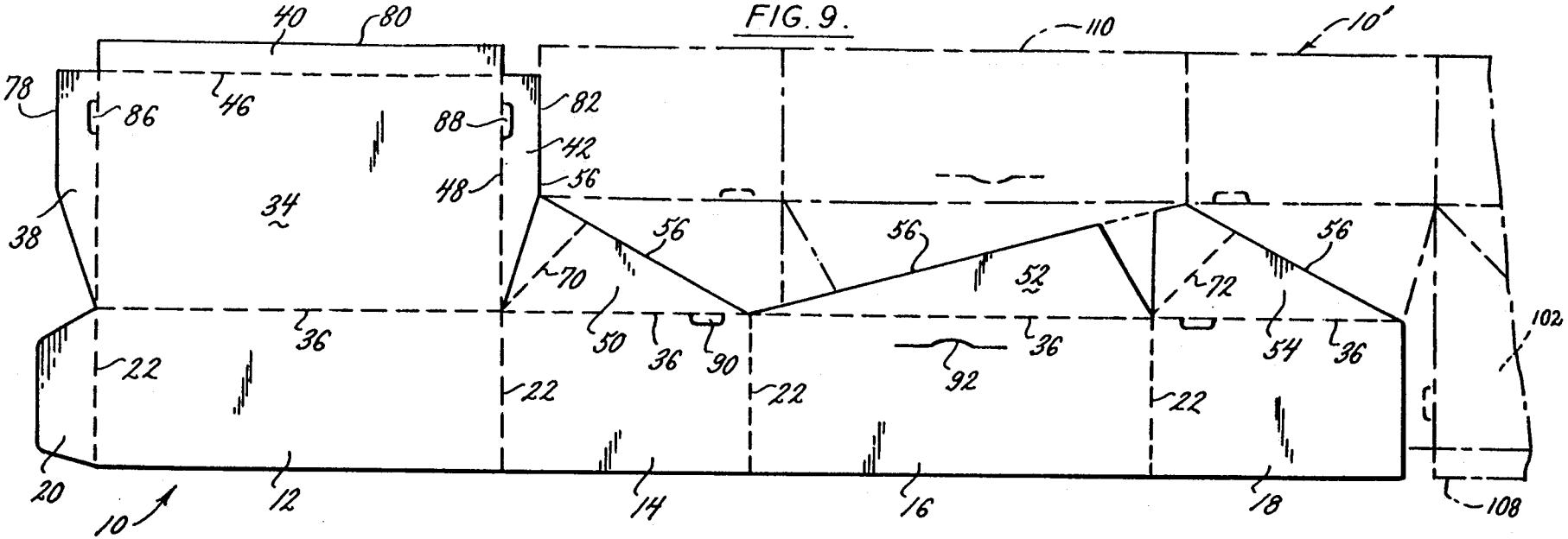
FIG. 9 is a view showing the arrangement of two confronting cartons of the second embodiment of the present invention on a single rectangular sheet of carton material.

The second embodiment of the folding carton of the present invention is similar to the first embodiment and like elements of the two cartons are numbered the same. The second embodiment of the folding carton is shown in FIGS. 9–16. FIG. 9 shows the arrangement of two cartons of the second embodiment positioned relative to each other to enable both folding cartons to be cut from the same rectangular sheet of carton material with a minimum of waste of the material.

Like the first embodiment, the folding carton of the second embodiment comprises first, second, third and fourth wall sections 12, 14, 16, 18, connected together in end-to-end fashion with a fold line 22 positioned between adjacent carton wall sections. A closure flap 20 is connected to one side of the first wall section 12 and is separated from the first wall section 12 by a fold line 22. The second embodiment differs from the first embodiment of the folding carton by having no reinforcement flaps connected to the top edges of any of the carton wall sections 12, 14, 16, 18.

A rectangular carton bottom section 34 is connected to a bottom edge of the first wall section 12. A fold line 36 is positioned between the carton bottom 34 and the wall section 12. Like the first embodiment, the carton bottom 34 of the second embodiment comprises first, second and third strengthening flanges 38, 40, 42 connected along its remaining three edges. Unlike the first embodiment of the folding carton, the second embodiment has a pair of tabs 86, 88 projecting from opposite sides of the carton bottom 34. The tab 86 projects from the fold line 44 scored along one side of the carton bottom 34 when the strengthening flange 38 connected along that side is folded at a right angle to the carton bottom 34 along the fold line 44. The tab 88 projects from the opposite side of the carton bottom 34 when the strengthening flange 42 is folded at a right angle to the carton bottom 34 along the fold line 48.

Just as in the first embodiment, the second, third and fourth carton wall sections 14, 16, 18 have respective first, second and third bottom supports 50, 52, 54 connected to a bottom edge of the respective wall sections. The fold line 36 separates the three bottom supports 50, 52, 54 from the three carton wall sections 14, 16, 18. The structure, assembly, and function of the three bottom supports 50, 52, 54, of the second embodiment of the folding carton is identical to that of the first embodiment of the folding carton and will not be further explained.

Three slots are provided in the second, third and fourth wall sections of the folding carton of the second embodiment. The first slot 90 is provided in the second wall section 14 of the folding carton, and is positioned along the fold line 36 at the bottom of the wall section and adjacent the fold line 22 between the second and third carton wall sections 14, 16. The second slot 92 is provided in the third carton wall section 16 and extends parallel to the fold line 36. The second slot 92 is centered horizontally between the fold lines 22 at opposite sides of the third wall section 16 and vertically above the fold line 36 but below the center of the carton wall section 16. The third slot 94 is provided in the fourth carton wall section 18 at a position on the fold line 36 and adjacent the fold line 22 between the third carton wall section 16 and the fourth wall section 18.

The second embodiment of the folding carton is manufactured in much the same manner as the first embodiment with one less step involved due to the absence of the four reinforcement flaps.

Figure 10:
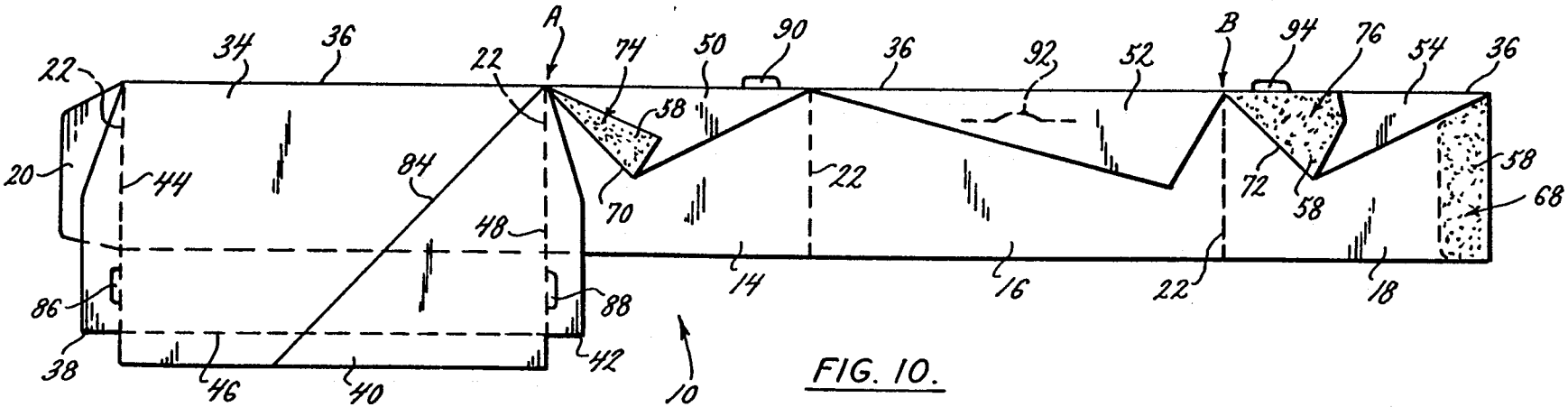
FIG. 10 shows a first step involved in producing the second embodiment of the folding carton of the present invention from a carton outline shown in FIG. 9.

FIG. 10 shows the first step in the manufacture of the folding carton of the second embodiment. In the first step, the carton bottom 34, the first bottom support 50, the second bottom support 52, and the third bottom support 54 are all folded down across the fold line 36 and over the first, second, third and fourth carton wall sections 12, 14, 16, 18 respectively, to the position shown in FIG. 10. As in the manufacture of the folding carton of the first embodiment, end portions of the first and third bottom supports 50, 54 are folded over at the fold lines 70, 72 respectively, to expose the respective areas 74, 76 for the application of glue. Glue 58 is applied to the exposed areas 74, 76 of the respective first and third bottom supports 50, 54, and to the area 68 of the fourth carton wall section 18 which will contact and adhere to the closure flap 20 of the folding carton in future steps of the carton's manufacture. The application of the glue completes the first step in the manufacture of the folding carton of the second embodiment.

Figure 11:
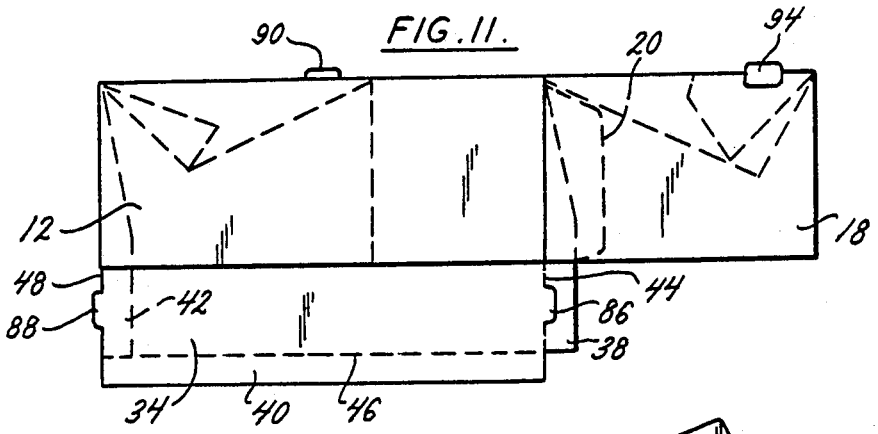
FIG. 11 shows a second step involved in the production of the second embodiment of the folding carton of the present invention.

The second step involved in the manufacture of the folding carton of the second embodiment is shown in FIG. 11. In this step, the first carton wall section 12 and the carton bottom 34 are together folded over both the fold line 22 between the first and second carton wall sections 12, 14, and the fold line 48 between the carton bottom 34 and the strengthening flange 42. The first wall section 12 and the carton bottom 34 are folded to the right of the folding carton across the fold lines 22 and 48 indicated at point A in FIG. 10. The first carton wall section 12 and the bottom section 34 are folded over to overlap the second wall section 14 and the third wall section 16. The exposed area 74 of the first bottom support 50 that has had glued applied to it is pressed against the carton bottom 34 and adhered to the carton bottom by the glue. In this position, the strengthening flange 42 is folded over across the fold line 48 to overlap a surface of the carton bottom 34 that will be the bottom surface of the carton when it is folded into its rectangular box configuration. As in the first embodiment of the invention, when folding the carton into the rectangular box configuration, the flange 42 must be folded around the fold line 48 to a position extending at a right angle to the inside surface of the carton bottom 34 and into the rectangular box configuration formed by the four carton wall sections 12, 14, 16, 18.

To complete the second step involved in the manufacture of the second embodiment of the folding carton, the fourth carton wall section 18 is folded to the left as viewed in FIG. 10 over the fold line 22 between the fourth wall section 18 and the third wall section 16 indicated at the point B. The exposed area 76 of the third bottom support 54 that has glue 58 applied to it is pressed against the second bottom support 52 and adhered thereto. The exposed area 68 of the fourth carton wall section 18 that has glue 58 applied to it is pressed against the closure flap 20 and adhered thereto. This step completes the manufacture of the second embodiment of the folding carton, and the carton is arranged in its flat-folded configuration as shown in FIG. 11. In the flat-folded configuration shown in FIG. 11, the second embodiment of the folding carton also has three overlapping layers. The top layer comprises the first carton wall section 12 and the fourth carton wall section 18, the middle layer comprises the carton bottom 34, and the bottom layer comprises the second carton wall section 14 and the third carton wall section 16.

To assemble the second embodiment of the folding carton into its rectangular box configuration from its flat-folded configuration shown in FIG. 11, the first and third wall sections 12, 16 are folded out from the flat-folded configuration to confront each other and the second and fourth carton wall sections 14, 18 are folded out from their flat-folded configuration to confront each other. As the angle between the third and fourth carton wall sections 16, 18 approaches 90°, the second and third bottom supports 52, 54, that have been glued to each other in the manufacture of the folding carton, are folded out and extend from the bottom edges of the third and fourth carton wall sections 16, 18 at right angles to the wall sections. As the angle between the first and second carton wall sections 12, 14 approaches 90°, the carton bottom 34 and the first carton bottom support 50 glued to the bottom 34 fold out from their flat-folded configuration toward a position extending at a right angle from the respective first and second carton wall sections 12, 14.

Figure 12:
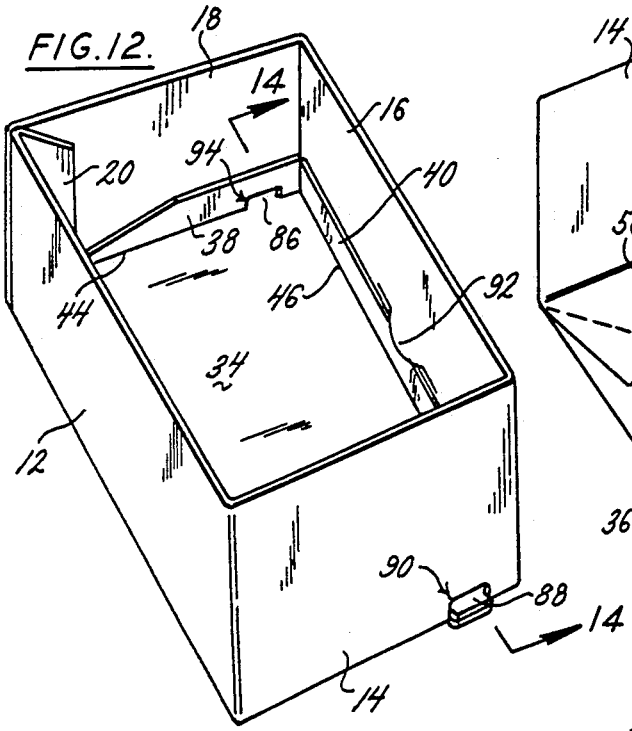
FIG. 12 shows a top perspective view of the second embodiment of the folding carton of the present invention folded into its rectangular box configuration.
Figure 13:
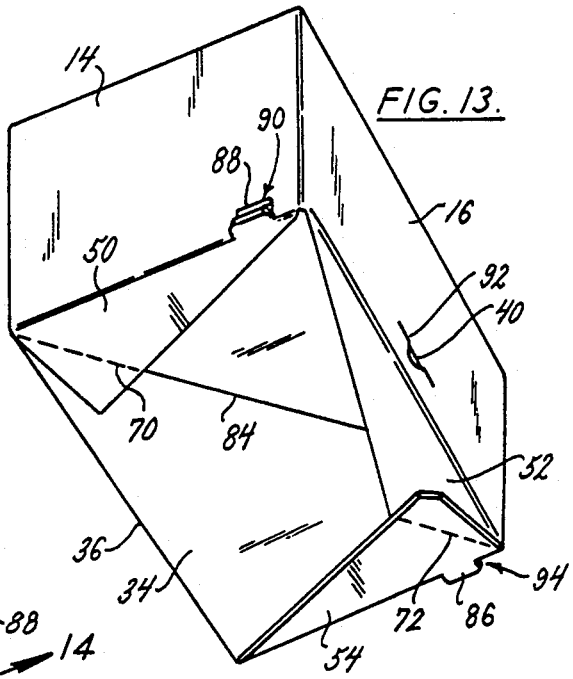
FIG. 13 shows a bottom perspective view of the second embodiment of the folding carton of the present invention folded into its rectangular box configuration.
Figure 14:
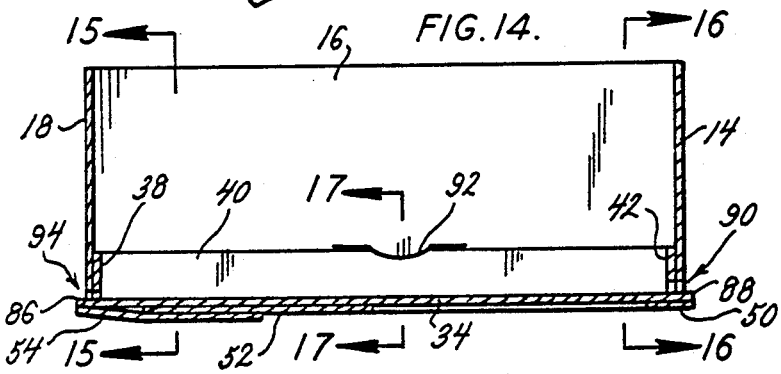
FIG. 14 shows a cut away view of the second embodiment of the folding carton of the present invention taken along line 14—14 of FIG. 12.
Figure 17:
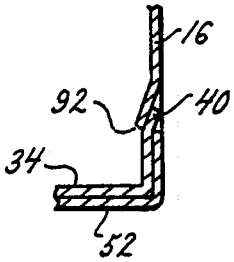
FIG. 17 shows a cut away view of the detail of the slot and strengthening flange coupling of the second embodiment of the folding carton of the present invention taken along line 17—17 of FIG. 14.
Figure 15:
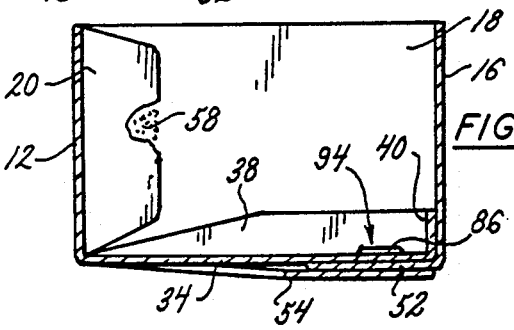
FIG. 15 shows a cut away view of the second embodiment of the folding carton of the present invention taken along line 15—15 of FIG. 14.
Figure 16:
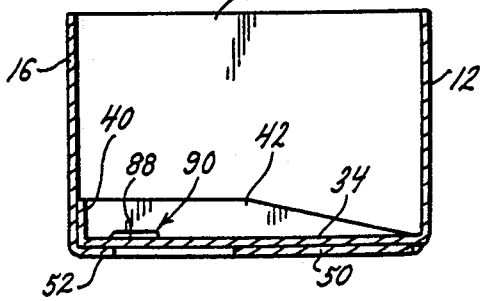
FIG. 16 shows a cut away view of the second embodiment of the folding carton of the present invention taken along line 16—16 of FIG. 14.

As the folding carton is folded into its rectangular box configuration, the carton bottom section 34 is pressed into the rectangular configuration toward a position at the bottom of the rectangular configuration formed by the four carton wall sections. As in the first embodiment, when the carton bottom section 34 is pressed into position, the strengthening flange 42 must be folded around the fold line 48 to a position relative to the carton bottom 34 that is opposite to its position relative to the carton bottom 34 when the folding carton is in its flat-folded configuration. In this position the strengthening flange 42 extends at a right angle to the inside surface of the carton bottom 34 into the rectangular box formed by the four carton wall sections. A diagonal score line 84 is provided across the bottom of the carton bottom section to enable the bottom section to bend at the score line 84 and to facilitate the insertion of the carton bottom section 34 into the rectangular configuration formed by the four carton wall sections. As the carton bottom 34 is pressed into the bottom of the rectangular box configuration formed by the four carton wall sections, the tabs 86, 88 on opposite sides of the carton bottom 34 engage in the respective slots 94, 90 in the sides of the respective fourth and second carton wall sections 18, 14. The strengthening flange 40 extending across the length of the carton bottom section 34 opposite the fold line 36 engages in the third slot 92 provided in the third carton wall section 16. With the first and second tabs 86, 88 engaged in the slots 94, 90 respectively, and the strengthening flange 40 engaged in the slot 92, the carton bottom 34 is locked in position at the bottom of the rectangular box configuration formed by the four carton wall sections 12, 14, 16, 18, as seen in FIGS. 12 and 13.

In the second embodiment of the folding carton, the first, second and third bottom supports 50, 52, 54, support the carton bottom 34 and prevent it from being pushed out of its position at the bottom of the rectangular box configuration formed by the four carton wall sections 12, 14, 16, 18, as in the first embodiment of the invention. The engagement of the tabs 86, 88 and the strengthening flange 40 in their associated slots 94, 90 and 92 respectively, maintains the carton bottom 34 in its position at the bottom of the rectangular box configuration formed by the four carton wall sections and prevents the carton bottom 34 from being pushed up into the rectangular box configuration. In addition, as in the first embodiment, the first, second and third strengthening flanges 38, 40, 42, provide reinforcement to and prevent bending of the carton bottom 34.

As stated earlier, the configuration of the folding carton of the present invention is designed to enable a pair or pairs of the folding cartons to be scored adjacent each other on a single blank sheet of carton material, while minimizing the amount of carton material that is discarded as waste after the pair or pairs of cartons are cut from the blank sheet. This is best illustrated by FIGS. 1 and 9 which show the relative positions of a pair of cartons 10, 10' of the present invention cut into a rectangular sheet of blank carton material 100, 102. The configuration of the cartons enables them to be placed side by side with the four wall sections 12, 14, 16, 18 of one folding carton being positioned longitudinally in line with the bottom section 34 of the other folding carton, and with the three bottom supports 50, 52, 54 of both of the cartons being positioned between three of the wall sections of the cartons. This configuration enables both folding cartons to be positioned completely between first and second opposed edges 104, 106, 108, 110 of the blanks of carton material with either the side walls of the folding cartons or the reinforcement flaps of the folding cartons coinciding with the first and second opposed edges of the blanks of carton material.

The first and second edges 104, 106 and 108, 110 scored on the blanks of carton material 100, 102 shown in FIGS. 1 and 9 respectively, extend longitudinally with the opposed edges of the blanks of material. However, it should be understood that the pairs of folding cartons of the present invention may be positioned on the blanks of carton material so that the first and second edges 104, 106, 108, 110, between which only one pair of folding cartons are positioned, may also extend laterally across the blank of carton material between the longitudinally extending edges of the material. It should be clear that either longitudinally or laterally positioning the pair of folding cartons of the present invention on the blank of carton material will result in reducing the amount of wasted material cut from the sheet of carton material and a more efficient use of the carton material in the production of each pair of folding cartons. Furthermore, it should be understood that more than one pair of adjacent folding cartons may be positioned side by side either longitudinally or laterally across the blank of sheet material.

While the present invention has been described by reference to specific embodiments, it should be understood that modifications, and variations of the invention may be constructed without departing from the scope of the invention defined in the following claims.

What is claimed is:

1. A folding carton formed from a blank sheet of carton material, the carton comprising:

first, second, third and fourth carton wall sections connected together end-to-end along fold lines scored between adjacent wall sections, the wall sections being arranged to be formed into a rectangular configuration;

a carton bottom section bound by four fold lines arranged in a rectangular configuration, the bottom section being connected to the first wall section along the first fold line and the bottom section being enclosed by first, second and third strengthening flanges connected respectively along the second, third and fourth fold lines of the bottom section in their entirety; and carton bottom locking means formed unitarily with the second, third and fourth carton wall sections and arranged to engage the first, second and third strengthening flanges respectively, to maintain the carton bottom section in a desired position relative to the four carton wall sections when the carton wall sections are formed into a rectangular configuration.

2. The folding carton of claim 1 comprising:

the bottom locking means including first, second, third and fourth wall reinforcement sections connected to the respective first, second, third and fourth carton wall sections along fold lines scored between each reinforcement section and a top edge of the connected wall section, each reinforcement section being arranged to be folded over at the fold line and adhered to the connected wall section so that a free edge of each reinforcement section opposite its fold line connection to a wall section forms an overhanging ledge above a bottom edge of the wall section.

3. The folding carton of claim 2 comprising:

the carton bottom section being arranged to be folded at the first fold line and inserted into a position at the bottom of the rectangular configuration formed by the first, second, third and fourth wall sections; and the first, second and third strengthening flanges being arranged to be folded at the respective second, third and fourth fold lines and to engage the overhanging ledge formed by the wall reinforcement sections to maintain the carton bottom section in position at the bottom of the rectangular configuration.

4. The folding carton of claim 1 comprising:

the first, second and third strengthening flanges being arranged to be folded at the second, third and fourth fold lines respectively, and to extend at right angles to the carton bottom section to provide additional support to the bottom section.

5. The folding carton of claim 1 comprising:

the carton bottom section being arranged to be folded at the first fold line and inserted into a position at the bottom of a rectangular configuration formed by the first, second, third and fourth wall sections; and a diagonal fold line scored diagonally across the carton bottom section, the diagonal fold line being arranged to facilitate the insertion of the bottom section in position at the bottom of the rectangular configuration formed by the four wall sections of the carton.

6. The folding carton of claim 1 comprising:

first, second and third carton bottom section supports connected to the respective second, third and fourth carton wall sections along fold lines between each bottom section support and a bottom edge of the connected wall section, each bottom section support being arranged to be folded at the fold line between the bottom section support and the connected wall section and to extend at a right angle to the connected wall section when the wall sections are formed into the rectangular configuration.

7. The folding carton of claim 6 comprising:

the carton bottom section being arranged to be folded at the first fold line and inserted to a position at the bottom of the rectangular configuration formed by the first, second, third and fourth wall sections, and being arranged to be supported by the first, second and third bottom section supports in position at the bottom of the rectangular configuration.

8. The folding carton of claim 1 comprising:

the first, second, third and fourth carton wall sections and the carton bottom section being arranged to be formed into a flat, three-layer configuration with the first and second wall sections forming one outside layer, the bottom section forming a middle layer, and the third and fourth wall sections forming an other outside layer.

9. The folding carton of claim 8 comprising:

one of the first, second and third strengthening flanges being folded over the carton bottom section when the first, second, third and fourth carton wall sections and the carton bottom section are formed into the flat, three-layer configuration.

10. A folding carton formed from a blank sheet of carton material, the carton comprising:

first, second, third and fourth carton wall sections connected together end-to-end along fold lines scored between the wall sections, the wall sections being arranged to be folded into a rectangular configuration;

a first slot extending through one of the second, third and fourth carton wall sections; and a carton bottom section having a rectangular configuration bounded by four fold lines, the bottom section being connected to the first wall section along the first fold line and the bottom section being enclosed by first, second, and third flange members connected respectively along the second, third and fourth fold lines of the bottom section in their entirety, the first flange member being arranged to engage in the first slot and maintain the bottom section in a desired position relative to the first, second, third and fourth carton wall sections, and the second and third flange members being arranged to be folded at an angle to the bottom section to strengthen the bottom section against bending when the wall sections are folded into the rectangular configuration.

11. The folding carton of claim 10 comprising:

the first flange member being connected to the bottom section along the second fold line, the second fold line extending between the bottom section and the first flange opposite the bottom section from the first fold line.

12. The folding carton of claim 10 comprising:

second and third slots, with each of the first, second and third slots extending through one of the second, third and fourth carton wall sections.

13. A folding carton formed from a blank sheet of carton material, the carton comprising:

first, second, third and fourth carton wall sections connected together end-to-end along fold lines scored between the wall sections, the wall sections being arranged to be folded into a rectangular configuration;

first, second and third slots, each extending through one of the second, third and fourth carton wall sections;

a carton bottom section having a rectangular configuration, the bottom section being connected to the first wall section along a first fold line between the bottom section and a bottom edge of the first wall section; and first, second and third flange members, the first, second and third flange members being connected to the carton bottom section along respective second, third and fourth fold lines between the bottom section and the flange members, the first flange member being arranged to engage in the first slot, and the second and third flange members having tab portions arranged to engage in the second and third slots respectively to maintain the bottom section in a desired position relative to the first, second, third and fourth carton wall sections when the wall sections are folded into the rectangular configuration.

14. The folding carton of claim 10 comprising:

first, second and third carton bottom section supports connected to the respective second, third and fourth carton wall sections along fold lines between each bottom section support and a bottom edge of the connected wall section, each bottom section support being arranged to be folded at the fold line between the bottom section support and the connected wall section and to extend at a right angle to the connected wall section when the wall sections are formed into the rectangular configuration.

15. The folding carton of claim 14 comprising:

the first, second and third carton bottom section supports being arranged to engage and support the bottom section in a desired position relative to the first, second, third and fourth carton wall sections when the wall sections are folded into the rectangular configuration.

16. Pairs of folding cartons formed on one blank sheet of carton material having opposed first and second longitudinally extending sides, each carton pair comprising:

first, second, third and fourth carton wall sections connected together longitudinally in line, end to end along fold lines between the wall sections, the wall sections being arranged to be formed into a rectangular configuration;

first, second, third and fourth carton bottom sections connected to the respective first, second, third and fourth carton wall sections along fold lines between each bottom section and the connected wall section, three of the bottom sections of each carton being positioned between wall sections of the pair of cartons formed on the blank, and one of the bottom sections of each carton being positioned longitudinally in line with the wall sections of the other carton formed from the blank.

17. Each pair of folding cartons of claim 16, wherein:

the three bottom sections of each carton are arranged to support the one bottom section when the carton wall sections are formed into a rectangular configuration.

18. The pairs of folding cartons of claim 16, wherein:

the first, second, third and fourth carton wall sections of one carton of the pairs border along the first longitudinally extending side of the blank sheet and the first, second, third and fourth carton wall sections of an other carton of the pairs border along the second longitudinally extending side of the blank sheet.

19. The pairs of folding cartons of claim 16, wherein: first, second, third and fourth wall reinforcement sections are connected to the respective first, second, third and fourth carton wall sections of each carton of the pairs, first, second, third and fourth wall reinforcement sections of one carton of the pairs border along the first longitudinally extending side of the blank sheet and first, second, third and fourth wall reinforcement sections of an other carton of the pairs border along the second longitudinally extending side of the blank sheet.

20. A pair of folding cartons formed on a single blank sheet of carton material having opposed first and second longitudinally extending sides, each carton comprising:

first, second, third and fourth carton wall sections connected together in line, end to end, along fold lines between the wall sections, the wall sections being arranged to be formed into a rectangular configuration;

first, second, third and fourth carton bottom sections connected to the respective first, second, third and fourth carton wall sections along fold lines between each bottom section and the connected wall section, three of the bottom sections of each carton being separated by a common cut line and being positioned between wall sections of the pair of cartons formed on the blank, and one of the bottom sections of each carton being positioned in line with the wall sections of the other carton formed on the blank; and first and second carton edges scored on the blank directly opposite to each other, the pair of cartons being the only cartons formed on the blank between the first and second carton edges.

21. The pair of folding cartons of claim 20, wherein: the first and second carton edges scored on the blank coincide with the first and second longitudinally extending sides of the blank.

22. The pair of folding cartons of claim 20, wherein: the first and second carton edges scored on the blank extend laterally across the blank between the first and second longitudinally extending sides of the blank.

23. The pair of folding cartons of claim 20, wherein: the first, second, third and fourth carton wall sections are formed connected together longitudinally on the blank.

24. The pair of folding cartons of claim 20, wherein: the first, second, third and fourth carton wall sections a formed connected together laterally on the blank.

25. The pair of folding cartons of claim 20, wherein: one of the bottom sections of each carton of the pair is formed on the blank longitudinally in line with the wall sections of the other carton of the pair formed on the blank.

26. The pair of folding cartons of claim 20, wherein: one of the bottom sections of each carton of the pair is formed on the blank laterally in line with the wall sections of the other carton of the pair formed on the blank.

27. The pair of folding cartons of claim 20, wherein: the first and second carton edges scored on the blank delineate first and second lines on the blank, and the pair of cartons are the only cartons formed on the blank entirely between the first and second delineated lines.

* * * * *